US006065995A

United States Patent [19]

Furukawa

[11] Patent Number: 6,065,995

[45] Date of Patent: May 23, 2000

[54] CIRCULAR DEVICE FOR MAKING ELECTRICAL CONNECTIONS

[75] Inventor: Tetsuya Furukawa, Yokkaichi, Japan

[73] Assignee: Sumitomo Wiring Systems, Ltd., Yokkaichi, Japan

[21] Appl. No.: 09/189,864

[22] Filed: Nov. 12, 1998

[30] Foreign Application Priority Data

Nov. 14, 1997 [JP] Japan ..... 9-313217

[51] Int. Cl.[7] ..... H01R 4/24; H01R 4/26; H01R 11/20

[52] U.S. Cl. ..... 439/408; 439/402

[58] Field of Search ..... 439/408, 790, 439/786, 590, 402

[56] References Cited

U.S. PATENT DOCUMENTS

| | | | |
|---|---|---|---|
| 3,798,587 | 3/1974 | Ellis, Jr. et al. | 339/97 P |
| 4,178,055 | 12/1979 | Fleischhacker | 439/402 |
| 5,622,516 | 4/1997 | Baggett | 439/408 |
| 5,733,139 | 3/1998 | Bray | 439/402 |

FOREIGN PATENT DOCUMENTS 63-03714 1/1987 Japan .

62-12077 10/1994 Japan .

OTHER PUBLICATIONS

An English Language abstract of JP 6–303714 Jan. 21, 1987.

AN English language abstract of JP 62–12077 Oct. 28, 1994.

*Primary Examiner*—Kheim Nguyen
*Assistant Examiner*—Javaid Nasri
*Attorney, Agent, or Firm*—Greenblum & Bernstein, P.L.C.

[57] ABSTRACT

Two cables containing electric wires are electrically connected via a connecting device. The device includes a plurality of electrical connection units arranged in parallel and linked via a flexible linking portion. Each of the electrical connection units includes a groove adapted for stacking an electric wire of a first cable and an electric wire of a second cable to be connected thereto. Each groove is mounted with a cutting element. When the electric wires are received in the groove, the cutting element cuts into the electric wires and contacts a wire core included in the electric wire. Adjacent electrical connection units are connected through a flexible linking portion. By virtue of this connecting device, the cables are easily connected on the installation site and generation of an excess length of the cable is avoided.

11 Claims, 7 Drawing Sheets

PRIOR ART

CIRCULAR DEVICE FOR MAKING ELECTRICAL CONNECTIONS

BACKGROUND OF THE INVENTION

1. Field of the Invention

The invention relates to a device for connecting electrical wire cables to each other, especially cables such as twisted paired wire cables, each of which comprises a plurality of electric wires. The invention also relates to a method of using the device.

2. Description of Background Information

In a network system for information communications, connection between outdoor cable-assembling devices (designated as "a hub") and a personal computer in an office may be carried out, for example, as shown in FIG. 1.

In the above system, an outdoor hub 100 and an outdoor modular jack panel 102 are connected via a modular cable 101. A twisted paired wire cable 103 is wired from the rear side of modular jack panel 102 and passes through a space for piping or under the floor in an office building. The twisted paired wire cable is then connected to a plug socket 105 located under the floor. Plug socket 105 and a personal computer 108 are then connected via a modular cable 107.

In the above system, plug socket 105 may comprise six sets of 8-pole modular jacks, for example. Twisted paired wire cable 103 is usually prepared by first twisting a pair of wires, secondly twisting four pairs thereof to obtain a "unit" electric line, and finally twisting six pairs of such a unit electric line to obtain a twisted paired wire cable 103 having 24 pairs of electric wires. Further, each end of twisted paired wire cable 103 is mounted with a connector, through which the twisted paired wire cable 103 is connected to modular jack panel 102 or plug socket 105.

However, the above-mentioned connecting system creates the following problems.

When installing the connector to the end portion of twisted paired wire cable 103, the installation must be carried out in facilities equipped with the necessary tools. Therefore, a predetermined length of cable 103 is prepared beforehand, and both ends thereof are mounted with a connector in the facilities. The assembly thus prepared is brought to the installation site, and is used for connecting modular jack panel 102 to plug socket 105. For this reason, the cable 103 prepared beforehand may actually have a length which deviates from the length actually needed at the installation site. This discrepancy may cause excess length when cable 103 is being installed.

The invention is designed to solve these problems. To this end, there is provided a device for making electrical connections between cables, in which the cables, each comprising a plurality of electric wires, are connected easily to each other at the installation site. By virtue of this device, the generation of excess length of the cable may be prevented. The invention also provides a method for using such a device.

SUMMARY OF THE INVENTION

According to one aspect of the invention, there is provided a device for making electrical connections between a first cable and a second cable, both cables comprising a plurality of electric wires containing a wire core and a coating. The device contains a plurality of electrical connection units arranged in parallel, and a plurality of linking portions linking the electrical connection units. The electrical connection unit contains at least one groove for receiving electric wires, and a cutting element. The cutting element contains at least one double-edge blade having two edges electrically connected and positioned so as to face each other in the groove, so that, when an electric wire taken out from the first cable is pressed into the groove, the double-edge blade cuts into the coating and contacts the wire core. When the electric wire taken out from the second cable is pressed into the groove, the double-edge blade cuts into the coating and contacts the wire core, whereby the electric wire taken out from the first cable is electrically connected to the electric wire taken out from the second cable through the double-edge blade.

Each of the electrical connection units may have a single groove, and the cutting element may contain one double-edge blade. The electric wire taken out from the first cable and the electrical wire taken out from the second cable are then pressed into the groove and stacked therein.

According to another aspect of the invention, the electric wire may have an end portion and each of the electrical connection units may contain a single groove having a first end section and a second end section. The cutting element may contain a pair of double-edge blades arranged in parallel and connected by an electrically conductive strip. When the cutting element is mounted in the groove, both the first and second end sections of the groove are provided with a double-edge blade, so that the end portion of the electric wire taken out from the first cable is pressed into the first end section of the groove, and the end portion of the electric wire taken out from the second cable is pressed into the second end section of the groove.

According to yet another aspect of the invention, the electric wire may have an end portion and each of the electrical connection units may contain a first groove and a second groove. The cutting element may contain a pair of double-edge blades arranged in the same plane and connected by an electrically conductive strip. When the cutting element is mounted in the first groove and in the second groove, both the first and second grooves are provided with a double-edge blade, so that the end portion of the electric wire taken out from the first cable is pressed into the first groove, and the end portion of the electric wire taken out from the second cable is pressed into the second groove.

Preferably, the device comprises a plurality of adjacent electrical connection units and a plurality of flexible linking portions linking the adjacent electrical connection units, and the device is formed into a circular shape by bending the electrical connection units.

Alternatively, the device may be formed into a spiral shape by bending the electrical connection units.

BRIEF DESCRIPTION OF THE DRAWINGS

The above and other objects, features, advantages of the present invention will become apparent from the following description of the preferred embodiments, given as non-limiting examples, with reference to the accompanying drawings and in which.

DETAILED DESCRIPTION OF THE PREFERRED EMBODIMENTS

Figure 2:
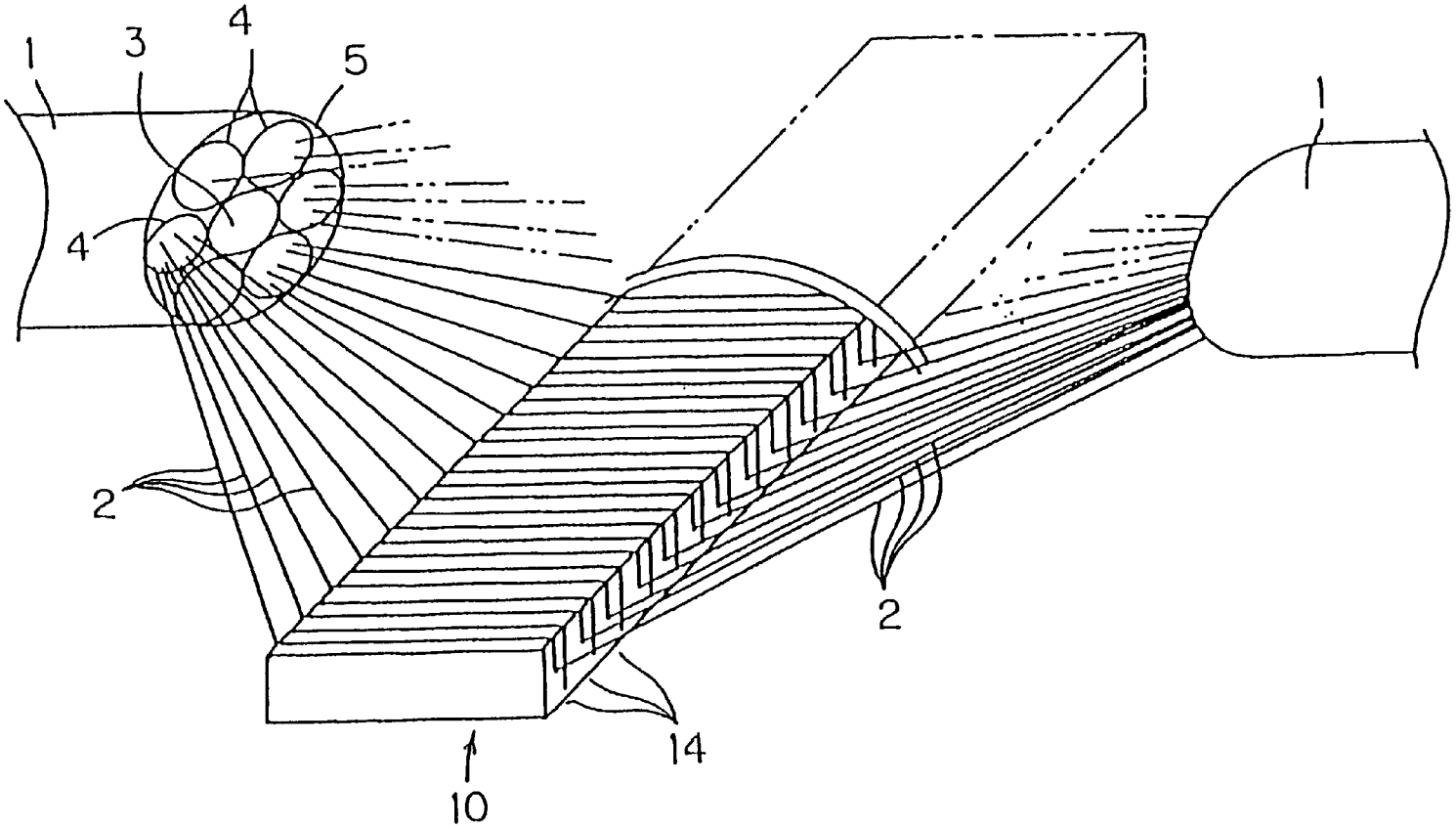
FIG. 2 is a perspective view of the device for connecting cables according to a first embodiment of the invention.

FIG. 2 shows a device for connecting cables according to a first embodiment of the invention, representing a state in which twisted paired wire cables 1 are connected to each other.

The electric wire 2 used in the invention comprises a wire core and a coating.

The twisted pair wire cable 1 is manufactured in a known manner, by first twisting two wires 2 to obtain a pair of twisted wires, then twisting 4 pairs thereof to obtain a unit electric line 4, and finally twisting 6 pairs thereof around an elongate core 3. All of these unit electric lines and elongate core are covered with a coating 5. A cable therefore contains 48 electric wires, i.e., 24 pairs of electric wires.

Figure 3:
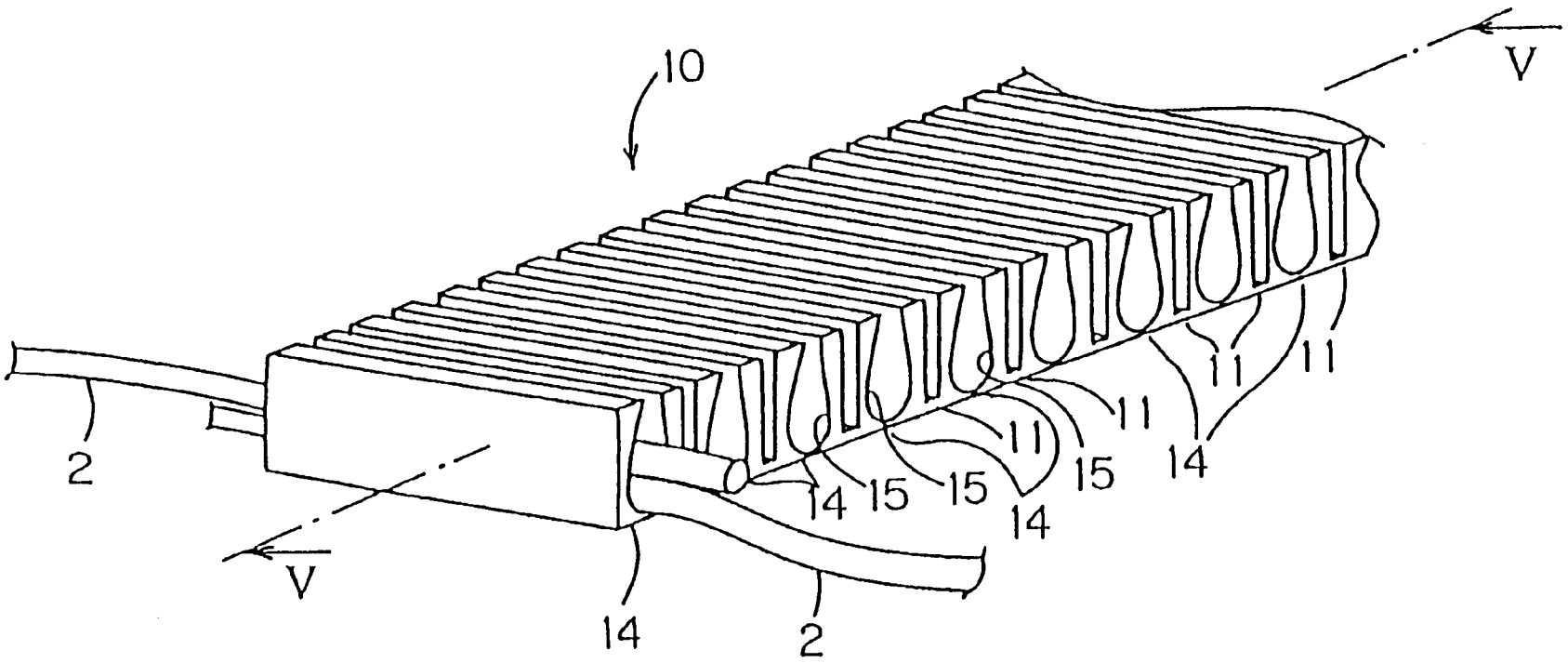
FIG. 3 is a perspective view of a plurality of electrical connection units of the device of FIG. 2.

The device for connecting cables 10 contains, as its main part, a plurality of electrical connection units 14 made, for example, of polyvinyl chloride, polyethylene or nylon. As shown in FIGS. 2 and 3, 48 electrical connection units 14 are arranged in parallel and connected to one another by linking portions 11.

Figure 4:
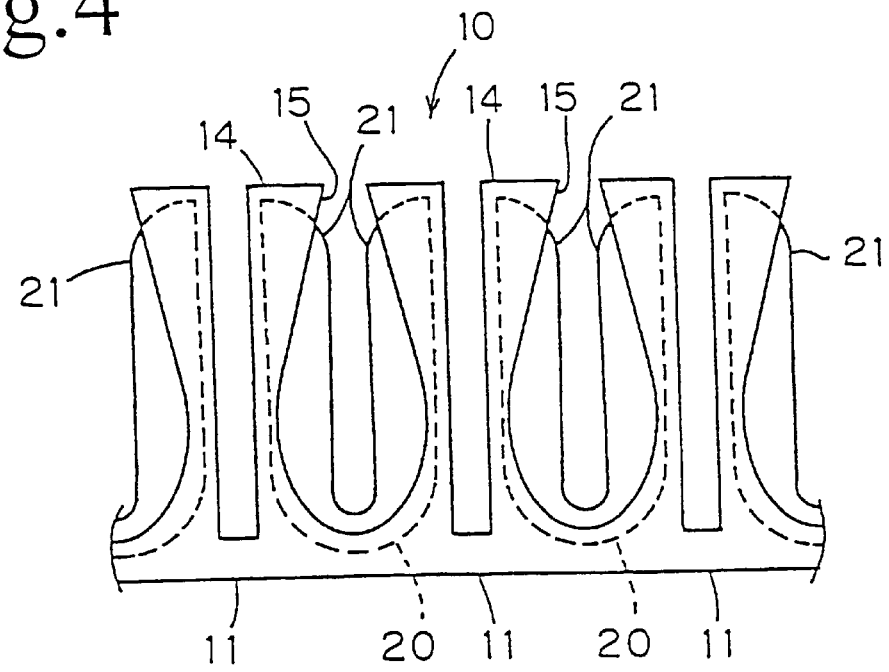
FIG. 4 is a side view of a plurality of electrical connection units of the device of FIG. 3.
Figure 5:
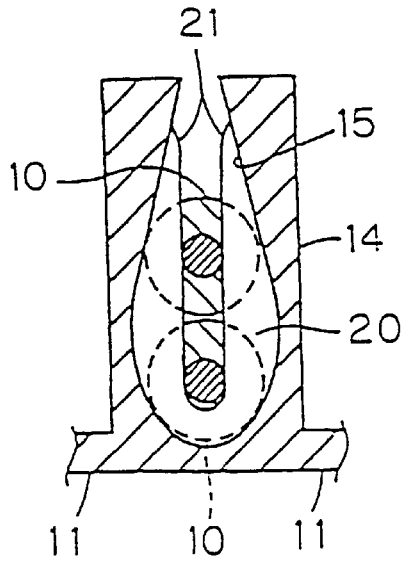
FIG. 5 is a cross-sectional view of an electrical connection unit of the device of FIG. 3, taken along line V—V in FIG. 3.

As shown in FIGS. 3 and 4, each of the electrical connection units 14 is in the form of a rectangular column. This column contains a groove 15 for receiving electric wires. Groove 15 has a tear-drop-like cross-section and a longitudinal upper opening (as viewed in the figures). As shown in FIG. 5, groove 15 has a depth sufficiently large to contain two electric wires 2 stacked vertically.

The groove 15 contains a cutting element 20 located approximately in the middle of groove 15 along the longitudinal direction. As shown in FIGS. 4 and 5, this cutting element 20 contains a double-edge blade which forms a U shape, viewed in the cross-section of groove 15, and an outer peripheral zone, distally positioned thereto, which is embedded along the inner side-wall of groove 15.

When cutting element 20 is mounted, double-edge blade 21 projects from each side of the inner side-wall of groove 15, and the two edges of blade 21 face each other. As electric wire 2 is pressed into groove 15, cutting element 20 cuts into the wire, thereby establishing an electrical contact.

The blade 21 has an edge depth which is at least twice the diameter of wire 2 and the distance between the two edges of double-edge blade 21, which face each other, is substantially the same as the diameter of the wire core of wire 2. Usually, the inner comer of cutting element 20 bridging both sides of double-edge blade 21 is rounded off.

The linking portion 11 is made thin, so that it can be freely bent and links adjacent electrical connection units 14 through a bottom rim portion.

In device 10, cables 1, shown in FIG. 2, are connected to each other as follows: firstly, for each cable 1 to be connected, each electric wire 2 is positioned in a freely movable state up to a predetermined length from one end of cable 1.

An electric wire 2 is taken out from a first cable 1 and pressed into a groove 15. Double-edge blade 21 inside groove 15 then cuts into the coating of electric wire 2 and contacts its wire core.

Likewise, an electric wire 2 is taken out from a second cable 1 and pressed into groove 15. Then, as shown in FIG. 5, double-edge blade 21 cuts into the coating of electric wire 2 and contacts the wire core.

In this way, electric wire 2 of the first cable 1 is arranged on one side and is electrically connected to electric wire 2 of second cable 1 arranged on the other side.

In the same way, each of the other electric wires 2 of respective cables 1 is connected via each of electrical connection units 14. Two cables 1 are thus connected to each other.

In the above-mentioned device 10, in order to connect two cables 1 comprising a plurality of electric wires 2, each corresponding electric wire 2 of respective cables 1 is simply pushed into corresponding groove 15, without removing the coating. Accordingly, handling of cables 1 is much simplified.

Figure 1:
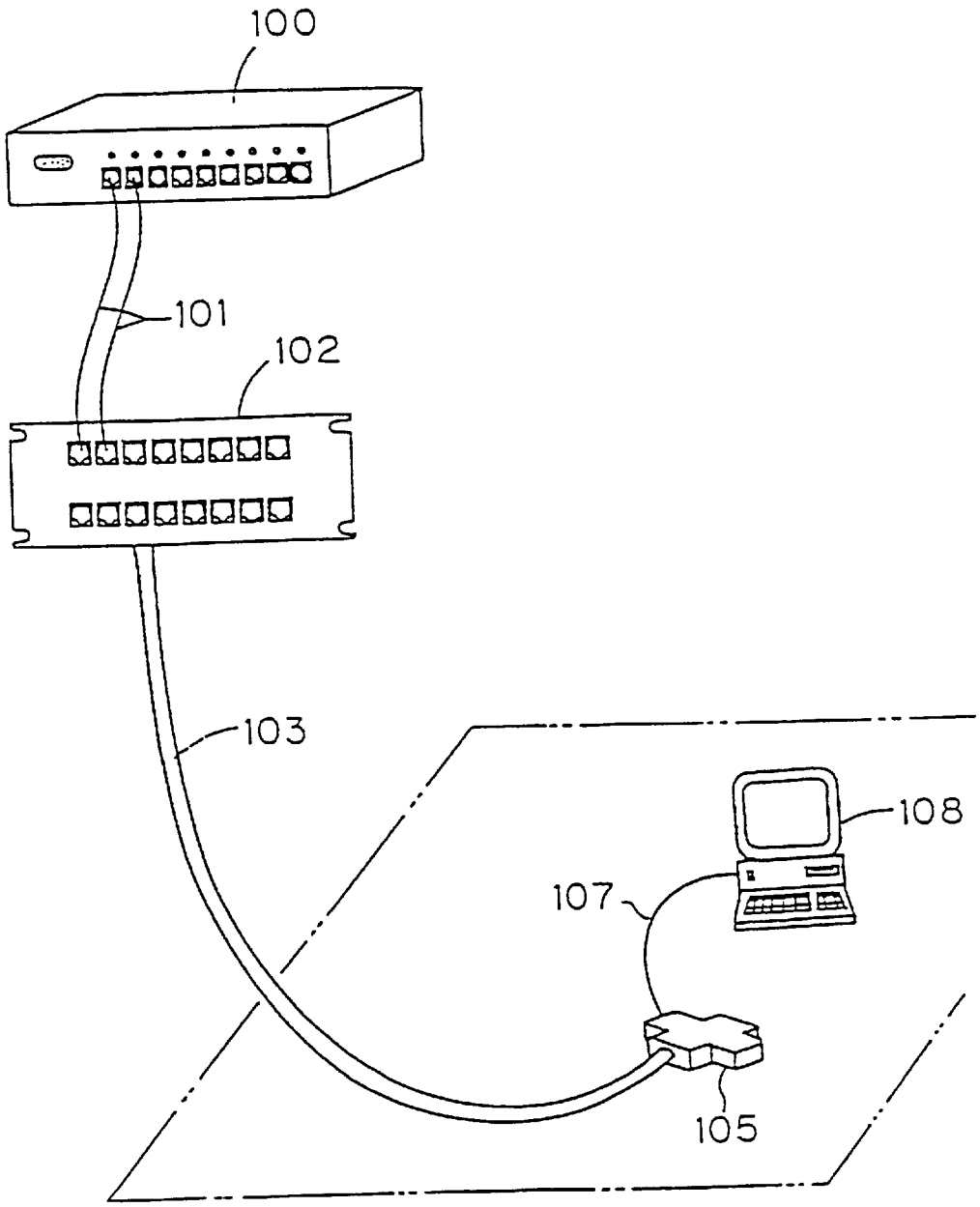
FIG. 1 shows an example of an electrical connection lay-out in known wiring network systems.

As shown in FIG. 1, when an outdoor modular jack panel 102 and a plug socket 105 are connected via a twisted paired cable 1 shown in FIG. 2, a first twisted paired wire cable 1 has one end thereof mounted with a connector for connecting modular jack panel 102. A second twisted paired wire cable 1 has one end thereof mounted with a connector for connecting plug socket 105. The first and second twisted wire cables are prepared and brought to the installation site. The connectors are thus mounted beforehand onto modular jack panel 102 and plug socket 105, respectively. The other end of respective twisted paired wire cables 1, to which end the connector is not mounted, is cut off at a desired length and both ends are linked by the device for connecting cables 10. In this manner, when wiring cables 1 at the installation site, generation of an excess length of cables 1 can be avoided.

Further, each electrical connection unit 14 is connected through a flexible linking portion 11. By flexing linking portions 11 at each linking position between electrical connection units 14, the device for connecting cables 10 can be deformed at will, so as to have a compact shape depending on the installation site.

Figure 6:
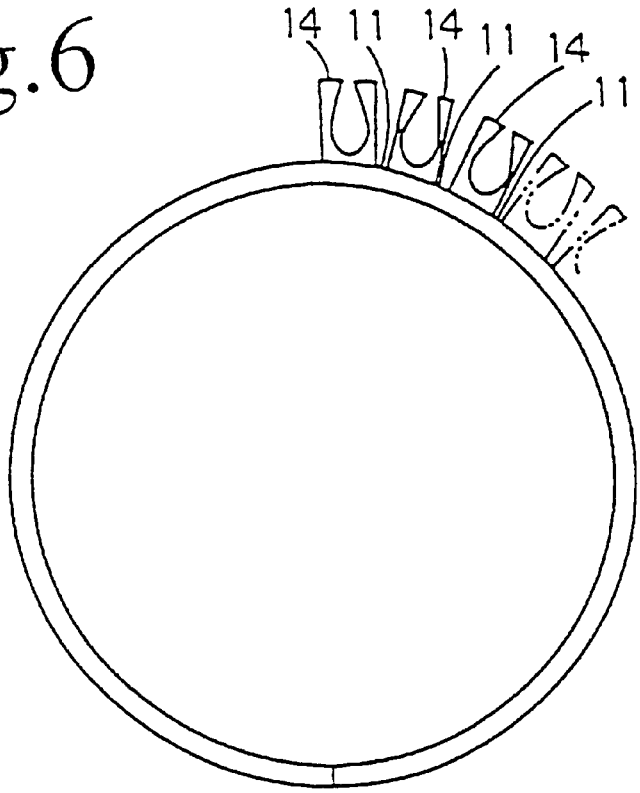
FIG. 6 schematically shows one aspect of the device according to the invention, when it is formed into a circular shape.
Figure 7:
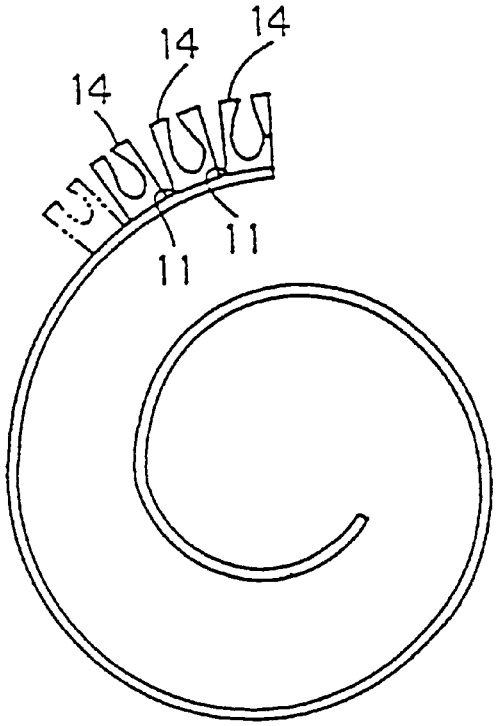
FIG. 7 schematically shows another aspect of the device according to the invention, when it is formed into a spiral shape.

In order to have a compact form, device 10 may be formed into a circular shape as shown in FIG. 6, or into a spiral shape as shown in FIG. 7. Device 10 is thus adapted to be contained in a narrow space, e.g., a space under the floor.

Figure 8:
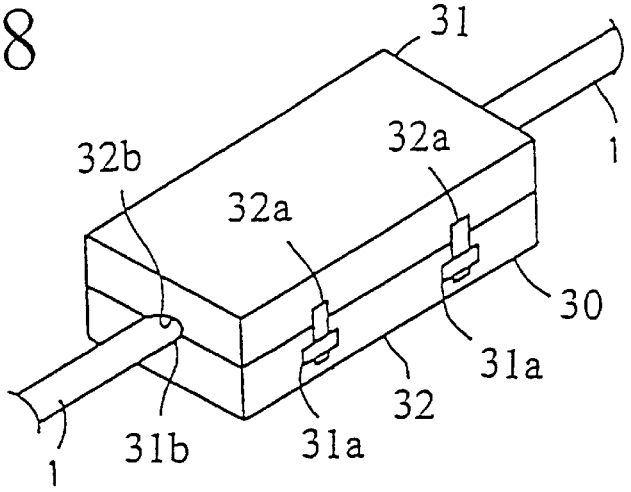
FIG. 8 is a perspective view of the device according to the invention, when it is contained in a case.
Figure 9:
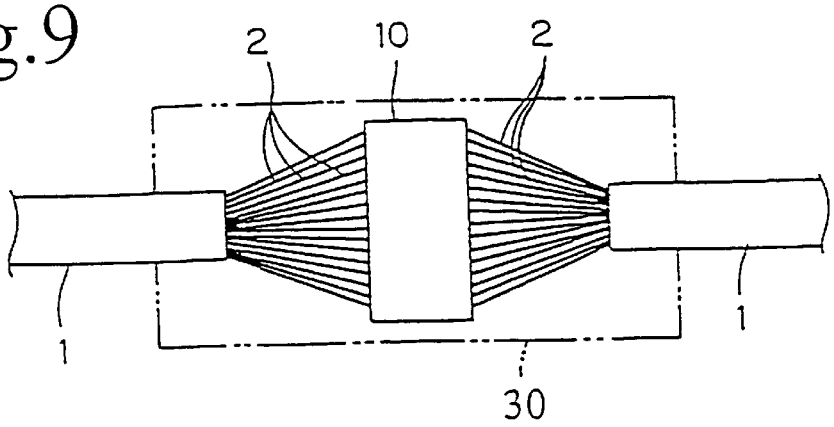
FIG. 9 schematically shows a top plan view of the device according to the invention, when it is inside the case.

When device 10 is rounded as shown in FIGS. 6 and 7, it is preferably contained in a rectangular parallelepiped case 30, as shown in FIGS. 8 and 9. Case 30 allows device 10 to maintain its shape and to be protected from outside forces.

The case 30 is divided into an upper case 31 and a lower case 32, which are linked at the rear side of case 30 via a hinge around which they can revolve. At the front side, a tongue 32*a* is fitted with a strip 31*a* in a freely attachable and removable manner. Further, the lateral sides of upper case 31 and lower case 32, which are stacked when closed, are provided with semi-circular notches 31*b* and 32*b* that correspond to the outer circular shape of twisted paired wire cable 1. Thus, the rounded device for connecting cables 10 can be stored in upper case 31 and lower case 32, and the twisted paired wire cable 1 can be drawn out from both sides of case 30 through notches 31*b* and 32*b*.

When twisted paired wire cable 1 is used in the network system shown in FIG. 1, a good electrical performance of the system is required for a high frequency bandwidth. For example, in the twisted paired wire cable classified in category 5, a good electrical performance is required at a frequency of, for example, 100 MHz. In this system, the Near-End-Crosstalk attenuation rate, which affects the electrical performance, is prevented by twisting electric wires 2. For this reason, when connecting two cables 1, the unraveling of twisted paired wires 2 should be avoided. According to the device for connecting cables 10, by shortening the length of groove 15 as much as possible, a fine electrical performance of cable 1 can be obtained.

Figure 10:
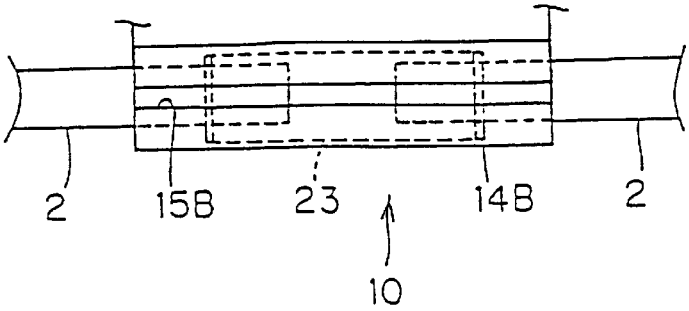
FIG. 10 is a top plan view of an electrical connection unit of the device according to another embodiment of the invention.
Figure 11:
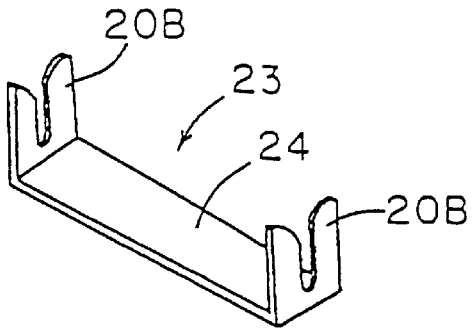
FIG. 11 is a perspective view of a cutting element according to the electrical connection unit of FIG. 10.

The electrical connection unit 14 may also be mounted with another type of cutting element, as shown in FIGS 10 and 11.

For example, cutting element 20 may contain a pair of double-edge blades 23, arranged in parallel as shown in FIG. 10. In this case, double-edge blades 23 are embedded in groove 15B of each electrical connection unit 14B. Double-edge blades 23 are prepared by bending two ends of an elongate plate, to obtain an electrically conductive strip 24 and double-edge blades 20B that extend substantially vertically, as in the case of double-edge blade 21 in cutting element 20 shown in FIGS. 4 and 5. One blade 20B of a pair of double-edge blades 23 is arranged at one end zone of groove 15B, whereas the other blade 20B thereof at the other end zone of groove 15B.

Thereafter, an electric wire 2 of first cable 1 is pressed into one end zone of groove 15B, so that blade 20B located at the side of the first cable 1 contacts the wire core of electric wire 2. Likewise, an electric wire 2 of second cable 1 is pressed into the other end zone of groove 15B, so that blade 20B located at the side of second cable 1 contacts the wire core of electric wire 2. In this way, both electric wires 2 are electrically connected via both blades 20B and electrically conductive strip 24.

Figure 12:
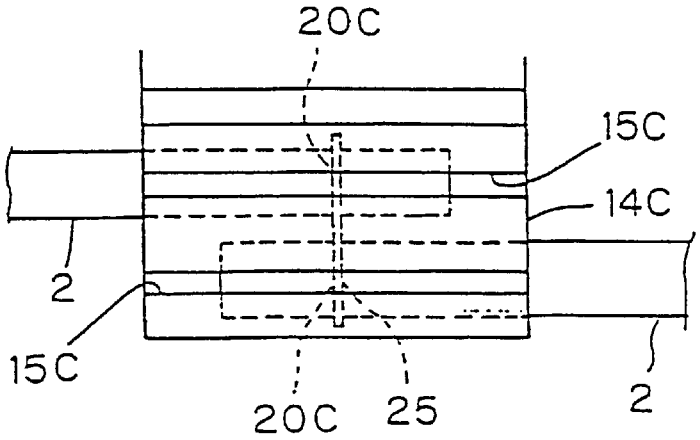
FIG. 12 is a top plan view of an electrical connection unit of the device according to yet another embodiment of the invention.
Figure 13:
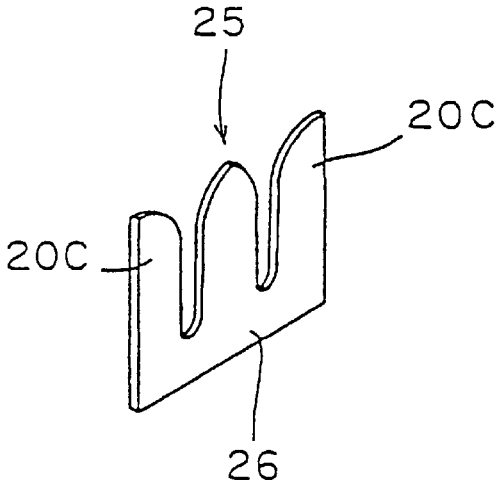
FIG. 13 is a perspective view of a cutting element according to the electrical connection unit of FIG. 12.

Further, electrical connection unit 14 may be arranged as shown in FIGS. 12 and 13.

For example, electrical connection unit 14C may be provided with a pair of grooves 15C for receiving wires arranged in parallel. Cutting element 20 may contain a pair of double-edge blades 25 arranged in the same plane. Then, double-edge blades 25 may be embedded in electrical connection unit 14C as shown in FIG. 12. Double-edge blades 25 are prepared by forming a pair of notches in a plate, such that the distance between the two notches corresponds to that between two grooves 15C. In this structure, two double-edge blades 20C, each having a similar shape as double-edge blade 21 shown in FIGS. 4 and 5, are linked via an electrically conductive portion 26. In this embodiment of the invention, one double edge blade 20C is disposed in a first groove 15C, whereas the other double-edge blade 20C in the second groove 15C.

Thereafter, an electric wire 2 of the first cable 1 is pressed into first groove 15C, so that one double-edge blade 20C contacts the wire core of first electric wire 2. Likewise, an electric wire 2 of second cable 1 is pressed into second groove 15C, so that the other double-edge blade 20C contacts the wire core of second electric wire 2. Both electric wires 2 are thus electrically connected via a pair of double-edge blades 20C and via electrically conductive portion 26.

If desired, a plurality of electrical connection units 14 may be aligned on a tape made of a resin, and the bottom of these units 14 may be bonded to the tape by melting or glueing.

The groove 15 may have a width which is constant in depth. As an example, the outer diameter of the wire core in electric wire 2 may be 0.51 mm, that of electric wire 2 may be 0.95 mm and that of cable 1 may be 18.0 mm. In order to connect such cables 1, a device for connecting cables 10 is prepared so as to have the following specifications: a width of electrical connection unit 14 of 2 mm, a height of 3 mm, a distance between a pair of blades 21 of 0.6 mm, and a width of groove 15 of 1 mm. After electric wires 2 are connected, device 10 is formed into a round shape such that its inner diameter measures 30.52 mm and its outer diameter, while comprising electrical connection unit 14, measures 36.52 mm. Two cables 1 having the above specifications can be connected easily.

As mentioned above, the device according to the present invention comprises a plurality of electrical connection units. This unit is provided with a groove for receiving electric wires, and a cutting element containing at least a pair of double-edge blades arranged in the groove, such that two edges of the double-edge blade face each other. An electric wire from a first cable and one from a second cable are then pressed into the groove, so that they are electrically connected via the pair of double-edge blades. In this fashion, a cable containing a plurality of electric wires can easily be connected to another cable on the installation site. As a result, generation of excess length of the cable may be avoided.

Further, the electrical connection units are arranged in parallel, and the adjacent units are connected to each other via a flexible linking portion. This linking portion can be flexed, such that the device for connecting cables forms a compact structure. For example, the device may be made compact by rounding the linking portions at each flexible position. In particular, the device may be made compact by being formed into a circular shape or a spiral shape.

Although the invention has been described with reference to particular means, materials, and embodiments, it is to be understood that the invention is not limited to the particulars disclosed and extends to all equivalents within the scope of the claims.

The present disclosure relates to subject matter contained in Japanese Patent Application No. 9-313217, filed on Nov. 14, 1997, the contents of which is expressly incorporated by reference herein in its entirety.

What is claimed:

1. A device for making electrical connections between a first cable and a second cable, said first and second cables including a plurality of electric wires having a wire core and a coating, said device comprising:

a plurality of adjacent electrical connection units arranged in parallel, and a plurality of linking portions linking said electrical connection units, each said electrical connection unit including at least one groove for receiving the electric wires, and a cutting element, each said cutting element including at least one double-edge blade having two edges electrically connected and positioned so as to face each other in said groove, wherein, when an electric wire taken out from said first cable is pressed into said groove, said at least one double-edge blade cuts into said coating and contacts said wire core, and, when an electric wire taken out from said second cable is pressed into said groove, said at least one double-edge blade cuts into said coating and contacts said wire core, whereby said electric wire taken out from said first cable is electrically connected to said electric wire taken out from said second cable via said at least one double-edge blade; and wherein the device is formed into a circular shape by bending said electrical connection units./

2. The device according to claim 1, wherein each of said electrical connection units includes a single groove and said cutting element includes one double-edge blade, wherein said electric wire taken out from said first cable and said electrical wire taken out from said second cable are pressed into said groove and stacked therein.

3. The device according to claim 2, wherein said device comprises a plurality of adjacent electrical connection units and a plurality of flexible linking portions linking said adjacent electrical connection units, wherein said device is formed into a circular shape by bending said electrical connection units.

4. The device according to claim 2, wherein said device comprises a plurality of adjacent electrical connection units and a plurality of flexible linking portions linking said adjacent electrical connection units, wherein said device is formed into a spiral shape by bending said electrical connection units.

5. The device according to claim 1, wherein said electric wire has an end portion and each of said electrical connection units includes a single groove having a first end section and a second end section, said cutting element including a pair of double-edge blades arranged in parallel and connected via an electrically conductive strip, wherein, when said cutting element is mounted in said groove, both said first and second end sections of said groove are provided with a double-edge blade, so that said end portion of said electric wire taken out from said first cable is pressed into said first end section of said groove, and said end portion of said electric wire taken out from said second cable is pressed into said second end section of said groove.

6. The device according to claim 5, wherein said device comprises a plurality of adjacent electrical connection units and a plurality of flexible linking portions linking said adjacent electrical connection units, wherein said device is formed into a circular shape by bending said electrical connection units.

7. The device according to claim 5, wherein said device comprises a plurality of adjacent electrical connection units and a plurality of flexible linking portions linking said adjacent electrical connection units, wherein said device is formed into a spiral shape by bending said electrical connection units.

8. The device according to claim 1, wherein said electric wire has an end portion and each of said electrical connection units has a first groove and a second groove, said cutting element including a pair of coplanar double-edge blades and connected via an electrically conductive strip, wherein, when said cutting element is mounted in said first and second grooves, both said first and second grooves are provided with a double-edge blade, so that said end portion of said electric wire taken out from said first cable is pressed into said first groove, and said end portion of said electric wire taken out from said second cable is pressed into said second groove.

9. The device according to claim 8, wherein said device comprises a plurality of adjacent electrical connection units and a plurality of flexible linking portions linking said adjacent electrical connection units, wherein said device is formed into a circular shape by bending said electrical connection units.

10. The device according to claim 8, wherein said device comprises a plurality of adjacent electrical connection units and a plurality of flexible linking portions linking said adjacent electrical connection units, wherein said device is formed into a spiral shape by bending said electrical connection units.

11. The device according to claim 1, wherein said device comprises a plurality of adjacent electrical connection units and a plurality of flexible linking portions linking said adjacent electrical connection units, wherein said device is formed into a spiral shape by bending said electrical connection units.

* * * * *